US012173984B2

(12) United States Patent
Swistak

(10) Patent No.: US 12,173,984 B2
(45) Date of Patent: Dec. 24, 2024

(54) FIREARM STOCK ADJUSTMENT DEVICE

(71) Applicant: Brandon Jeremiah Swistak, Trinity, NC (US)

(72) Inventor: Brandon Jeremiah Swistak, Trinity, NC (US)

( * ) Notice: Subject to any disclaimer, the term of this patent is extended or adjusted under 35 U.S.C. 154(b) by 73 days.

(21) Appl. No.: 17/652,249

(22) Filed: Feb. 23, 2022

(65) Prior Publication Data

US 2022/0268552 A1 Aug. 25, 2022

Related U.S. Application Data

(60) Provisional application No. 63/152,627, filed on Feb. 23, 2021.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/04; F41A 11/04
USPC ..... 42/75.03, 73, 71.01
See application file for complete search history.

(56) References Cited

U.S. PATENT DOCUMENTS 616,424 A * 12/1898 Rowley ..... F41C 23/16 42/74
2,282,428 A * 5/1942 Rigandi ..... F41C 23/08 42/74
3,710,496 A * 1/1973 Packmayr ..... F41C 23/14 42/71.01
4,120,108 A * 10/1978 Vickers ..... F41C 23/08 42/74
4,203,244 A * 5/1980 Hickman ..... F41C 23/14 42/73
4,644,930 A * 2/1987 Mainhardt ..... F41B 11/62 42/1.06
5,265,365 A * 11/1993 Finn ..... F41C 23/00 42/74
5,771,622 A * 6/1998 Koziuk ..... F41C 27/00 42/74
5,970,642 A * 10/1999 Martin ..... F41C 23/00 42/74
7,398,616 B1 * 7/2008 Weir ..... F41C 23/20 42/72
8,341,867 B2 * 1/2013 Criswell ..... F41C 23/14 42/73
8,789,306 B1 * 7/2014 Mazzoni ..... F41C 33/04 42/71.01
9,488,435 B1 * 11/2016 Roberts ..... F41C 23/14
9,523,552 B2 * 12/2016 Eitan ..... F16B 37/122
(Continued)

*Primary Examiner* — Michael D David
(74) *Attorney, Agent, or Firm* — Au Law Office, P.C.; Yiu F. Au

(57) ABSTRACT

A firearm stock adjustment device for attachment to a firearm stock provides for a consistent, stable cheek weld and improves speed and consistency for an aimed shot. The device includes a thickness that fills and empty space between the maxilla and the front of the mandible with the firearm stock during a cheek weld and provides rest to the zygomatic arch and bone and pushes the firearm outward away from the jaw and tilts the head more vertically. This provides a quick and consistent sighting with the firearm when the cheek weld is performed and reperformed. The device is disposable, lightweight, cost effective, and comfortable and is universally attachable to common rifle stocks.

20 Claims, 5 Drawing Sheets

(56) References Cited

U.S. PATENT DOCUMENTS

| | | | | |
|---|---|---|---|---|
| 9,784,526 | B2 * | 10/2017 | Chow | F41C 23/06 |
| 9,791,227 | B2 | 10/2017 | Hayes | |
| D819,769 | S * | 6/2018 | Stevens | D22/108 |
| D823,979 | S * | 7/2018 | Stevens | D22/108 |
| D823,980 | S * | 7/2018 | Stevens | D22/108 |
| 10,088,267 | B2 * | 10/2018 | Slater | F41C 23/14 |
| D836,746 | S * | 12/2018 | Tyrone | D22/108 |
| 2007/0101631 | A1 * | 5/2007 | Bentley | F42B 39/02<br>42/74 |
| 2010/0180484 | A1 * | 7/2010 | Aalto | F41A 35/06<br>42/74 |
| 2011/0016764 | A1 * | 1/2011 | Cales | F41C 23/14<br>42/90 |
| 2012/0110884 | A1 * | 5/2012 | Criswell | F41C 23/14<br>42/71.01 |

* cited by examiner

FIREARM STOCK ADJUSTMENT DEVICE

CROSS REFERENCE TO RELATED APPLICATIONS

This application claims the benefit of U.S. Provisional Application No. 63/152,627, filed Feb. 23, 2021, which is herein incorporated by reference.

BACKGROUND OF THE INVENTION

Field of the Invention

The present invention generally relates to a device for adjusting firearm stock, and more particularly to an apparatus, device, and method for adjusting rifle stock for a human user of the firearm in a shooting position.

Description of the Related Art

Firearm stock, gunstock, or stock refers to a part of a firearm (typically a long gun, e.g., a rifle) that provides structural support to firing mechanisms of the firearm, such as the barrel, action, gun sight, and other components. The stock is typically at a rear of the firearm (where the opening of the gun barrel where the bullet is shot from the firearm is the front). The back portion of the firearm is referred to as the butt or buttstock and is typically supported by the human shooter (e.g., by the shoulder of the user) to brace the firearm for aiming and stability with shooting the firearm.

The typical firearm stock requires the human shooter to spending considerable time and effort to align and aim his or her sight picture for shooting the firearm. Typically, the human is required to spend effort to hold and stabilize the firearm while aiming in order to make a controlled and aimed shot at a target. The human shooter has to account for considerable factors such as eye placement, head tilt, stock design, the individual human's size and length of pull, the stretch of the shooter's arm and finger interacting with the trigger, and/or the stock's placement with respect to the shoulder. These factors can make placing a well-aimed shot (e.g., with the correct sight and optic alignment) frustrating, uncomfortable, and tiring.

There are deficiencies with the related art. One device in the related art is a cheek riser that is permanently attached to the firearm stock. The cheek riser may allow for some customization for a particular human head rest or placement while aiming and shooting the firearm. However, the cheek riser may be heavy in weight and is designed for a particular rifle. In addition, the cheek riser increases a rise of the cheek on the rifle stock, which changes the designed parameters (e.g., aiming angle) of the rifle, among other disadvantages. The cheek riser may also make the firearm unwieldy when the shooter is shooting at various shooting position, e.g., a prone position.

There is a need in the art for a simple, versatile, and cost-effective device for adjusting stock for a human shooter.

SUMMARY OF THE INVENTION

Accordingly, the invention is directed to a device for adjusting firearm stock for a human shooter that substantially obviate one or more of the problems due to limitations and disadvantages of the related art.

An advantage of an embodiment is to provide a device for adjusting a firearm stock that is user placeable on the firearm stock and universally acceptable for various firearm stocks.

The ability for user placement allows the device to be a custom fit for different human shooters using the firearm. The simplicity and indiscriminateness of the method to place the device on various firearm stocks allows the device to be universally acceptable by various firearm stocks. The one device fits all approach of an embodiment allows cost savings in production and distribution.

Another advantage of an embodiment is to provide a lightweight and comfortable device for adjusting a firearm stock for a human shooter. The ability to use lightweight material allows the weight balance, and other handling characteristics of the firearm to be maintained, which provides consistency to a shooter handling the firearm (e.g., at various shooting positions or when carrying or transporting the firearm and to avoid unnecessary cheek rises when using a cheek riser). The ability to use comfortable materials (such as compressible, flexible, elastic, and/or resilient material but not necessarily strong and/or rigid materials) allows further comfort to the parts of the human body making contact with the device while the human shooter is using the firearm. Further, a greater tolerance may be allowed in the production process when the device is not use for substantially any structural support (e.g., actually supporting a human body part or needing to prop up the device when the device is attached to the firearm stock).

Another advantage of an embodiment is to provide an easily disposable and replaceable device for cost-effectiveness and customization for different human shooters (e.g., using the same firearm at different times), and untroubled replacement of a worn device.

Yet another advantage of an embodiment is to provide a device with a relatively compact shape and size with a low profile. The firearm with the device attached would have minimal size increase and continue to fit an existing case for the firearm without removing the device. Further, the compact shape and small size with a low profile of the device blends in with the firearm and is visually and physically unobtrusive.

Still yet another advantage of an embodiment is to protect and prolong the life of the firearm stock. A firearm stock may routinely be in contact with the human shooter, who may produce sweats, oil, or other substances which may harm the endurance and life of the stock. The device attached to the stock acting as the main contact component with the human shooter provides added barrier and protection to the firearm stock.

Additional features and advantages of the invention will be set forth in the description which follows, and in the art will be apparent from the description, or may be learned by practice of the invention. The objectives and other advantages of the invention will be realized and attained by the structure particularly pointed out in the written description and claims hereof as well as the appended figures.

According to an embodiment, a firearm adjustment device, comprises an attachment to an area of a stock of a firearm that is originally configured to receive a cheek area of a shooter of the firearm; and a raised top configured to receive the cheek, wherein the raised top is longitudinally elongated, and wherein a thickness of the raised top and the attachment fills a space between the cheek area and the firearm. The thickness is about 0.28 inches. A side of the raised top is angled with respect to the attachment and the raised top. The raised top is tactilely textured. The raised top comprises a monolithic piece of foam material. The attachment comprises adhesive. The raised top provides rest to a zygomatic bone of the shooter. The space is between a maxilla and a mandible of the shooter and the firearm. A length of the space is about 0.75 inches. A length of the device is about 5.5 inches.

According to another embodiment, a firearm stock, comprises a firearm stock adjustment device, wherein the device comprises an attachment to an area of a stock of a firearm that is originally configured to receive a cheek area of a shooter of the firearm; and a raised top configured to receive the cheek, wherein the raised top is longitudinally elongated, and wherein a thickness of the raised top and the attachment fills a space between the cheek area and the firearm. The thickness is about 0.28 inches. A side of the raised top is angled with respect to the attachment and the raised top. The raised top is tactilely textured. The raised top comprises a monolithic piece of foam material. The attachment comprises adhesive. The raised top provides rest to a zygomatic bone of the shooter. The space is between a maxilla and a mandible of the shooter and the firearm. A length of the space is about 0.75 inches. A length of the device is about 5.5 inches.

It is to be understood that both the foregoing general description and the following detailed description are exemplary and explanatory and are intended to provide further explanation of the invention as claimed.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible, utilizing, alone or in combination, one or more of the features set forth above or described in detail below.

BRIEF DESCRIPTION OF THE FIGURES

The accompanying figures, which are included to provide a further understanding of the invention are incorporated in and constitute a part of this specification, illustrate embodiments of the invention and together with the description serve to explain the principles of the invention.

DETAILED DESCRIPTION

Reference will now be made in additional detail to an embodiment of the present invention, example of which is illustrated in the accompanying figures.

Figure 1A:
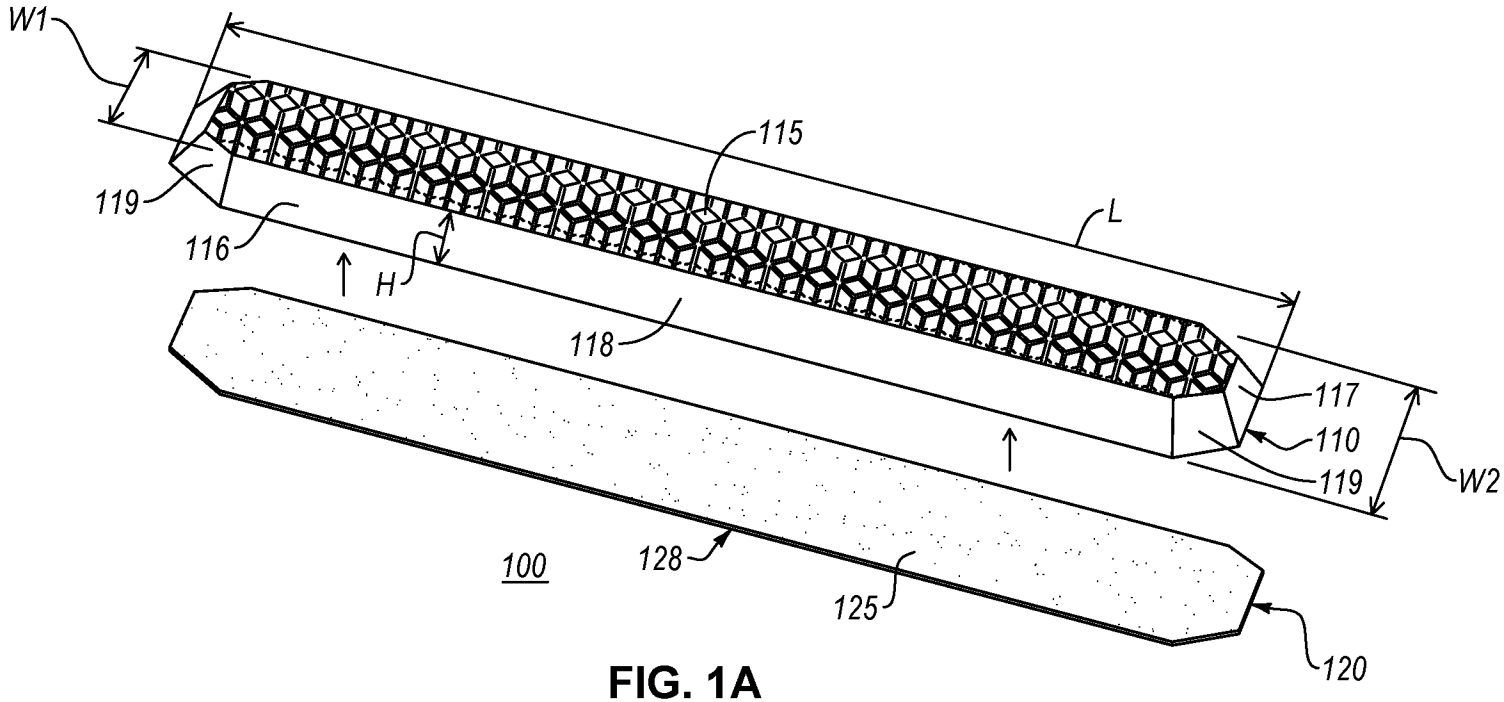
FIG. 1A illustrates an exploded view of a firearm stock adjustment device according to an embodiment.
Figure 1B:
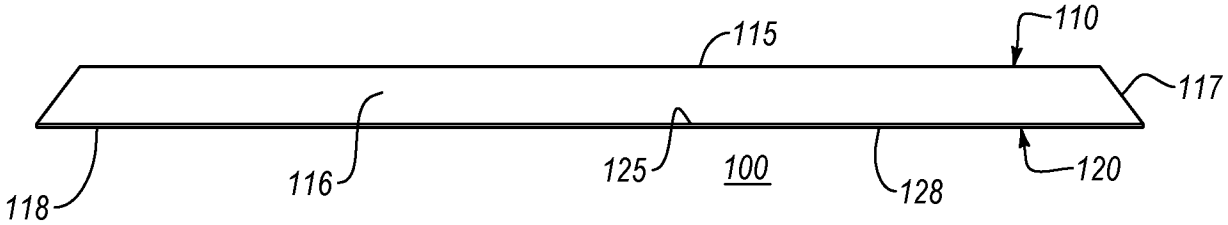
FIG. 1B illustrates a front view of a firearm stock adjustment device according to an embodiment.

FIG. 1A illustrates an exploded view of a firearm stock adjustment device according to an embodiment; FIG. 1B illustrates a front view of a firearm stock adjustment device according to an embodiment.

The firearm stock adjustment device 100 includes a top layer 110 and a bottom layer 120. In an embodiment, the top layer 110 may be a pad for accommodating a human shooter at around the cheek or jaw when the device is attached to a firearm stock. The pad may be used for sight and optic alignment for the human shooter to aim and shoot the firearm. In an embodiment, the bottom layer 102 may be an adherent (e.g., an adhesive layer) for attaching the device 100 to the firearm stock.

In an embodiment, the top layer 110 may be made of one or a combination of various materials such as metal (e.g., steel, aluminum iron, titanium), polymer (e.g., foam, rubber, urethane, polyurethane, polystyrene, latex, silicon, plastic), organic materials (e.g., sponge, cloth type pad or base), or other suitable materials as known now or may be later derived. In a preferred embodiment, the top layer 110 may be made of materials and/or shape that has sufficient combination of compressive, flexible, elastic, and/or resilient properties (e.g., to provide comfort and stability for the cheek or jaw of the human shooter in contact with top layer 110). For example, the top layer 110 may be made of a polymer type material (e.g., foam) that has an internal structure filled with air pockets for being able to compress for softness and comfort to the cheek or jaw and will be able to simultaneously apply sufficiently force to the cheek or jaw for returning to the original shape of the top layer 110 for stability. In another example, the top layer 110 may be made of a metal type material and is shaped (e.g., shaped to a spring) such that the top layer 110 can similarly both compress and apply a returning force to the check or jaw. Further, the top layer 110 may be made of materials that are sufficiently durable (e.g., able to continue to compress and apply a return force after substantial usage of the device 100).

In further embodiments, the top layer 110 may be made of materials with differing parameters. For example, the hardness of the material (e.g., elasticity, stiffness, plasticity, strength, durometer, etc.) may affect the comfort of the human shooter, while a softer material may be able to absorb more comfortable compared to with the harder material. However, a harder material may be more durable than a softer material, leading to higher and longer reliability of use and less frequent need for replacement of the top layer 110 and/or the device 100. The thickness of the top layer 110 may also vary depending on the need for quality, durability, aesthetics, and/or other needs and may be designed and/or tested to achieve desirable results. In an embodiment, a durable coating may be applied to the top layer 110 for added durability and longevity for use.

In embodiments, the top layer 110 may be manufactured by methods as known now or may be later derived. In an embodiment, thermoforming may be used and is preferably for low volume production. In the thermoforming process, production of the top layer 110 may use materials such as a 2 and 101b Ethylene-vinyl acetate (EVA), polyethylene (PE) foam, polyurethane (PU) foam, or other suitable materials. In another embodiment, mass production of the top layer 110 may be performed using casting (e.g., resin casting, die casting) or molding (e.g., blow molding, injection molding). In a further embodiment, other methods of manufacturing may be used including 3D printing.

The top layer 110 includes a top side top 115, sides (e.g., sides 116 and 117), and a bottom 118. The top 115 has a width W1, at least one of the sides (e.g., sides 116 and 117) have a height H, and the bottom 118 has a length L and a width W2. In a preferred embodiment, all of the sides have substantially the height H. In an embodiment, the top layer 110 is shaped as a straight elongated piece where the length L is multiples larger than the width (e.g., widths W1 and W2).

In an embodiment, the sides (e.g., sides 106 and 107) may be angled (as opposed to straight and perpendicular with the top 115 and bottom 118) such that width W2 is greater than width W1, and the length of the top 115 is larger than length L of the bottom 118. This may provide advantages such as more stability with a larger base and area of contact of the device 100 for attachment to the firearm stock, where the device 100 may experience lateral force from a human shooter in contact with the device 100 (e.g., when the cheek or jaw is pushed against the device 100 at various angle before resting at a position). In an embodiment, the ends of the elongated length of the top layer 110 may include one or more faces at the corners (e.g., faces 119). These faces 119 and the larger base at the bottom 118 may provide further grip, comfort, aesthetic or other functions for the human shooter (e.g., fitting the contour of the cheek or jaw). In other embodiments, the faces 119 (or the sides 116 and 117) may be other contour shapes (e.g., approximate contours of certain feature of the face of the human shooter).

In an embodiment, the top 115 may be textured, patterned, or otherwise provide tactile sensation or better grip or friction for the human shooter when in contact with the top 115.

In a preferred embodiment, for the top layer 110, the length L is 5.5 inches, the width W1 is 0.5 inches, the width W2 is 0.75 inches, and the height H is 0.27 inches.

In an embodiment, the bottom layer 120 (e.g., for attachment of the device 100 to the firearm stock) may be made of and/or contain attachment materials (e.g., adhesive or other fastener materials) for the attachment to the firearm and the top layer 110. In embodiments, the attachment material may include one or a combination of pressure sensitive adhesive (PSA), adhesive transfer tape (e.g., 9775 tape by 3M), a hook and loop fastener (e.g., Velcro material). In a preferred embodiment, the bottom layer 120 may be a double coated tape with 2.0 mils aggressive rubber-based PSA on each side of a 0.5 mil tape carrier. Therefore, the thickness (including the height H) of the device 100 may be around 0.28 inches in a preferred embodiment.

In an exemplary use, the device 100 is provided as the top layer 110 attached to the bottom layer 120 (e.g., by adhesive of the top 125 of the bottom layer 120 to the bottom 118 of the top layer 110) and has an adhesive backing (e.g., on the bottom 128 of the bottom layer 120) for relatively temporary attachment to a firearm stock (e.g., as a user modifiable part of the firearm that is not part of the original manufacturer product).

In another embodiment, the device 100 (and/or the top layer 110) may be attached to the firearm or other fixed objects by other attachment methods (e.g., nail, screw, rivet, nut and bolt, etc.) as known now or may be later derived. In an exemplary use, a firearm may be produced (e.g., by the manufacturer) or modified (e.g., in after-market) to include the device 100 as a relatively permanent fixture.

It is noted that the device 100 (and/or the top layer 110) may be produced of various colors, shapes, and sizes for aesthetic reasons (e.g., for the preference of the user, manufacturer, distribution, or other entities). For example, various surfaces of the top layer 110 may carry labels, logos, or other brandings. In an embodiment, the device 100 may be packaged with labeling of logos and/or advertisements (e.g., packaged as a give-away item).

Figure 2:
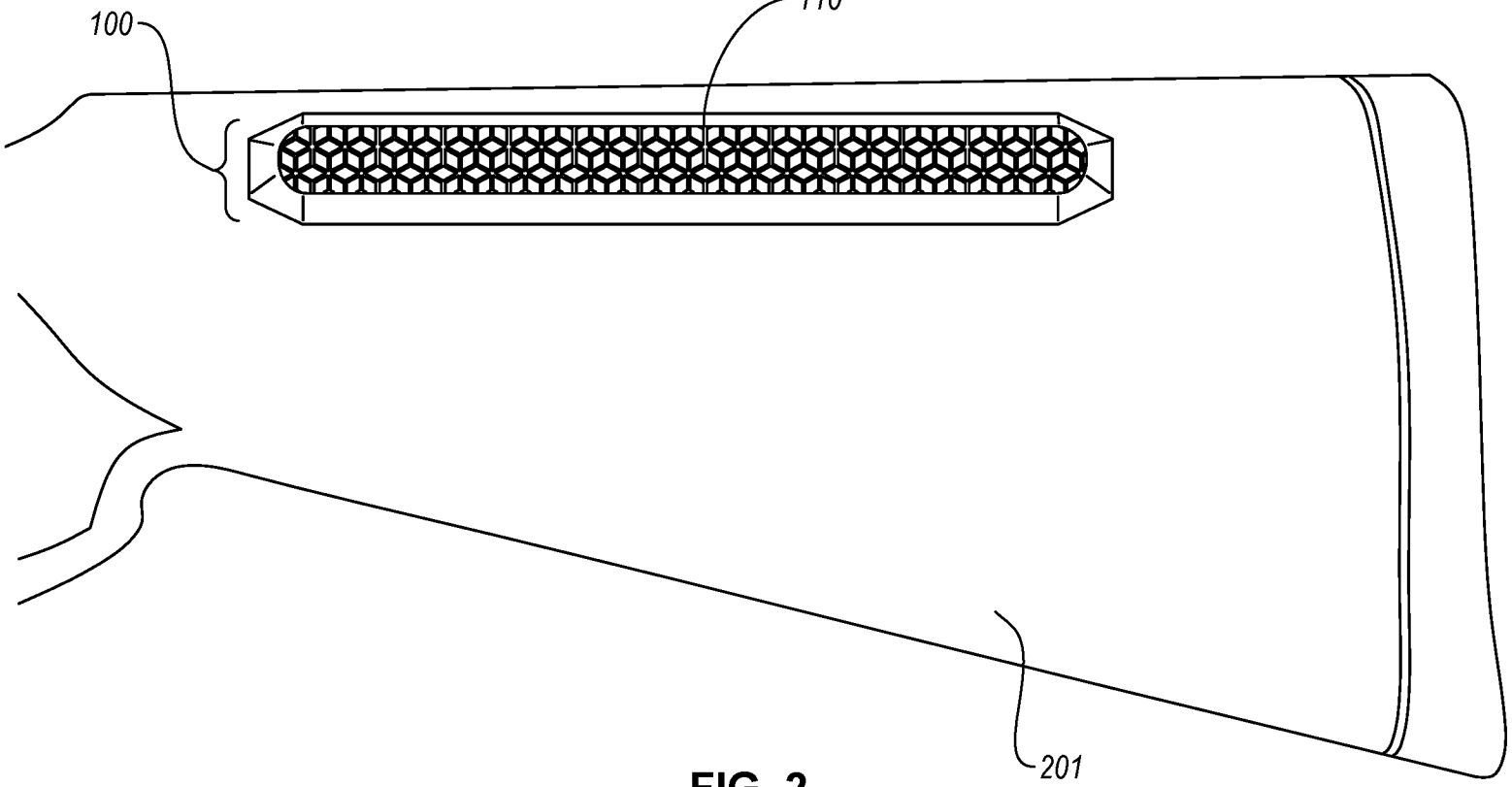
FIG. 2 illustrates a view of a firearm stock adjustment device attached to an exemplary fixed rifle stock according to an embodiment.

FIG. 2 illustrates a view of a firearm stock adjustment device attached to an exemplary fixed rifle stock according to an embodiment.

A firearm stock adjustment device 100 may be attached to stock 201 of a fixed rifle stock. In a preferred embodiment, the device 100 is attached at a location towards the top of the stock 201 where the human shooter is expected to contact the stock 201 to shoot the rifle for an aimed shot. In an embodiment, the placement location of the device 100 may be on the relatively flat area just below the curved top of the stock, to allow sturdy and durable application of the adhesive or other attachment materials. In an embodiment, instruction (e.g., text, drawing, or video) may be provided with the device 100 as a kit for an individual to attach the device 100 to the rifle.

Figure 3:
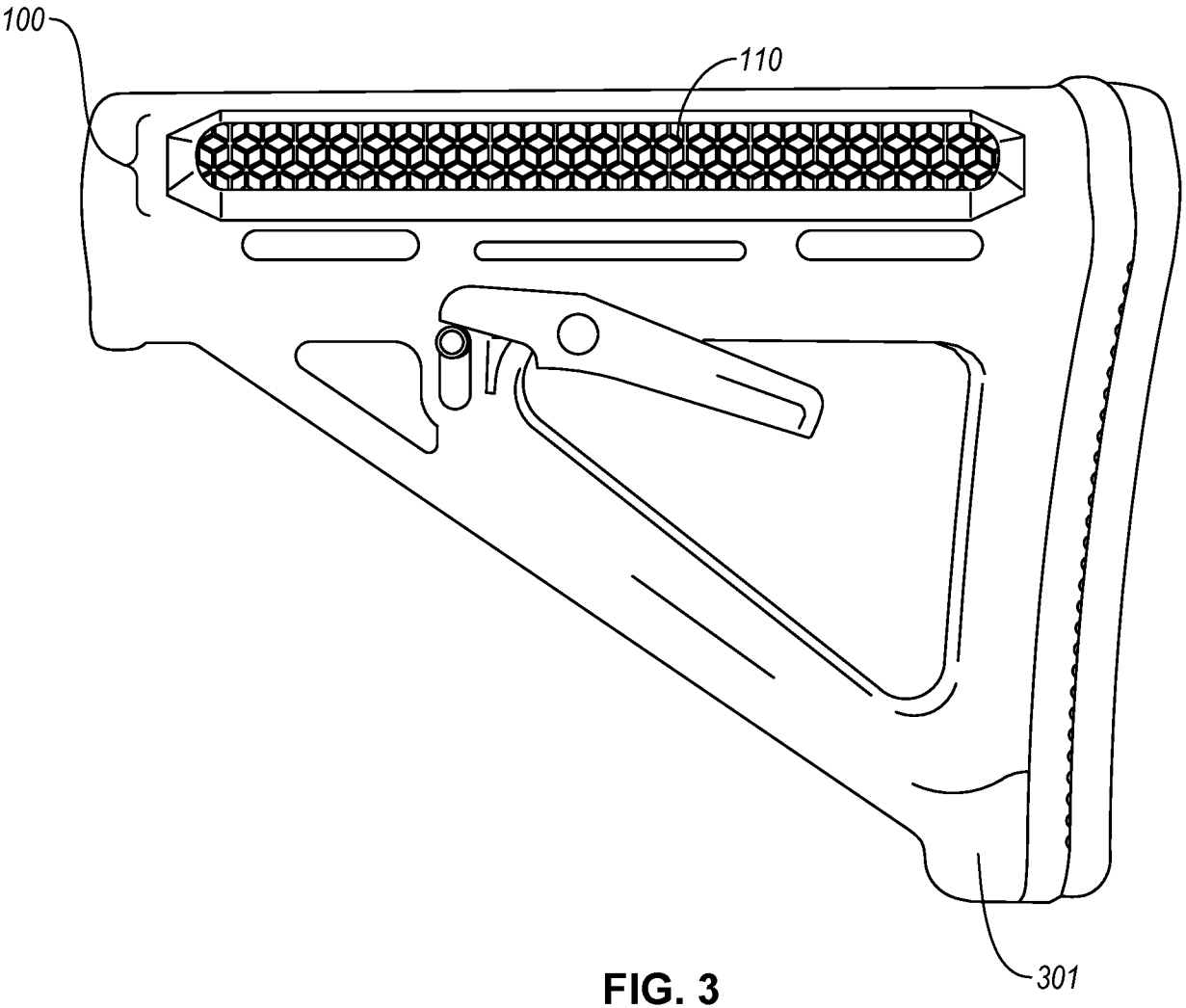
FIG. 3 illustrates a view of a firearm stock adjustment device attached to exemplary adjustable rifle stock according to an embodiment.

FIG. 3 illustrates a view of a firearm stock adjustment device attached to an exemplary adjustable rifle stock according to an embodiment.

A firearm stock adjustment device 100 may be attached to stock 301 of a adjustable rifle stock. In a preferred embodiment, the device 100 is attached at a location towards the top of the stock 201 where the human shooter is expected to contact the stock 301 to shoot the rifle for an aimed shot. In an embodiment, the placement location of the device 100 may be on the relatively flat area just below the curved top of the stock, to allow sturdy and durable application of the adhesive or other attachment materials. In an embodiment, instruction (e.g., text, drawing, or video) may be provided with the device 100 as a kit for an individual to attach the device 100 to the rifle.

Figure 4:
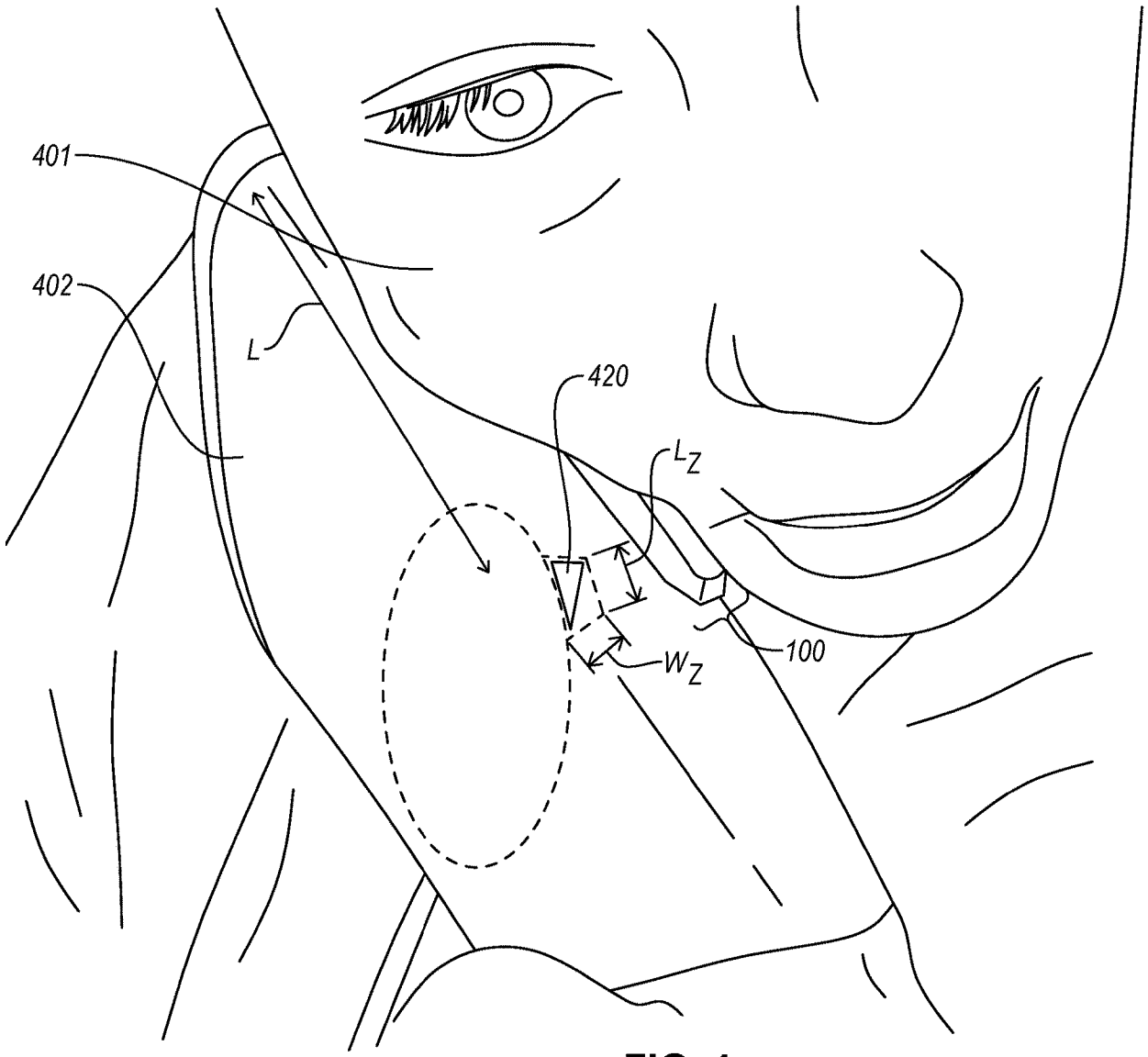
FIG. 4 illustrates an exemplary human shooter using the device attached to a rifle stock according to an embodiment.

FIG. 4 illustrates an exemplary human shooter using the device attached to a rifle stock according to an embodiment.

In marksmanship, a consistent cheek weld is important for consistent and effective aimed shot of a firearm. Typically, a cheek weld is established by contacting area of the cheek of the human shooter to the intended area of the rifle stock. The cheek weld allows the human shooter to have good and comfortable alignment with sight or optics for an aimed shoot. The intended area of the cheek weld may depend on the firearm, the sight or optic, the human body size, the clothing or body armor worn by the human, and/or other factors. A consistent cheek weld, when the area of the cheek contacts intended area of the rifle stock in a consistent manner improves the accuracy of the aim for consistent and accurate shooting.

In establishing the cheek weld, a human shooter pushes his or her cheek area 401 to one side of the rifle stock 402. It is noted that the rifle stock 402 generally has a round contour and not shaped or contoured to a human shooter's cheek or jaw area. When the cheek area 401 is pushed against the rifle stock 402, cheek area 401 makes contact with the rifle stock 402 at a substantially oval shaped area 410 (area 410 is shown on the other side of the rifle stock 402 in the figure for explanatory purpose). However, the contact of the cheek area 401 with the rifle stock 402 is not complete, as there is a substantially triangle shaped zone 420 where the maxilla and the front portion of the mandible should rest on the rifle stock 402 (zone 420 is shown on the other side of the rifle stock 402 in the figure for explanatory purpose). The triangle shaped zone 420 is therefore an empty space that causes instability when the human shooter is trying to establish the cheek weld with the rifle stock 402.

In an embodiment, the front portion of a firearm adjustment device 100 fills the triangle shaped zone 420. When the cheek area 401 is in position of the rifle stock 402, the device fills the gap represented by the triangle shaped zone 420 and provides a natural rest for the entire cheek area 401 for establishing a cheek weld, providing a solid and stable connection with the rifle stock 402. By removing the unnecessary empty space (e.g., triangle shaped zone 420) by filling the space with comfortable material that cushions and allows the human shooter's face to rest upon, uncontrollable movement such as shaking or teetering of the head while trying to maintain a sight picture through the optics prior to and during pulling of the trigger of the fireman may be reduced or eliminated. Accordingly, the device 100 provides additional surface area of contact for the check area 401 with the rifle stock 402, which creates a stable, customized, and comfortable platform that allows for faster and more consistent sight acquisition.

At each time the rifle stock 402 is cheeked and recheeked (e.g., when the human shooter creates and recreates the cheek weld), there is a potential lateral error that needs immediate correction before the correct sight is acquired. That is, the potential lateral error caused by the unstable empty space represented by triangle shaped zone 420 creates potential for overcorrection of the width of the zone $W_Z$.

The width of the zone $W_Z$ may be at least 0.28 inches for a typical human shooter (e.g., the empty space between the maxilla and the front of the mandible with the rifle stock 402). In an embodiment, the width of the zone $W_Z$ corresponds to the thickness of the device 100, which is 0.28 inches in the preferred embodiment. In an embodiment, the length of the zone $L_Z$ corresponds to the width W2 of the device 100 and provides additional support to the front of cheek area 402 (e.g., between the maxilla and the front of the mandible) with the thickness of the device 100. The length of the zone $L_Z$ may be around 0.75 inches, which corresponds to $W_2$ in the preferred embodiment. In the preferred embodiment, the length L is 5.5 inches to accommodate head placement of a typical human shooter shooting with a typical length firearm stock.

Figure 5:
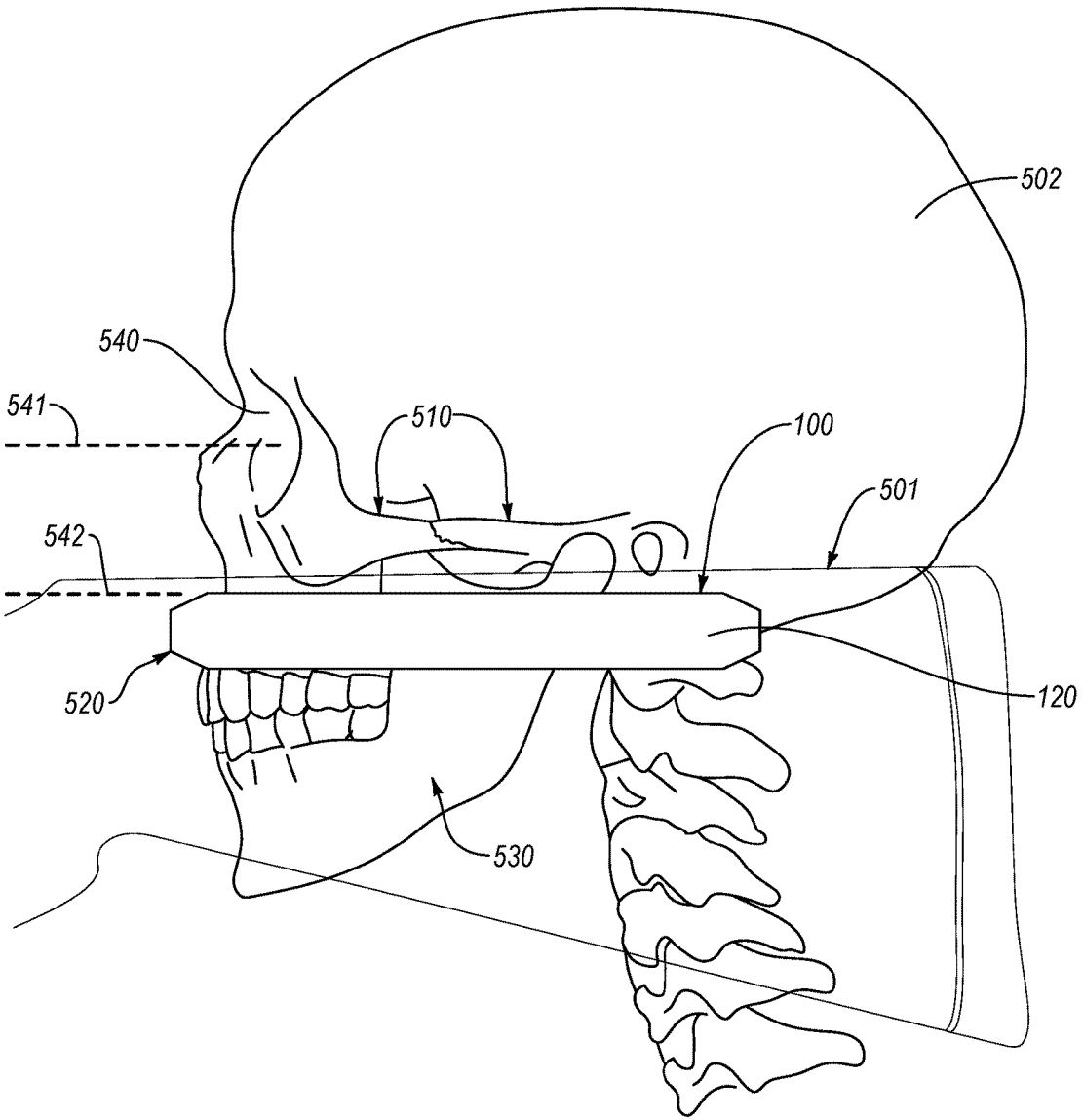
FIG. 5 illustrates a view of a skull of an exemplary human shooter using the device attached to a rifle stock according to an embodiment.

FIG. 5 illustrates a view of a skull of an exemplary human shooter using the device attached to a rifle stock according to an embodiment.

For explanation of the human shooter's head anatomy when using the firearm stock adjustment device 100, skull 502 of the human shooter's head is shown. The device 100 is attached to rifle stock 501 (shown as contour only with see through showing features behind the rifle stock 501). The bottom layer 120 of the device 100 attaches to the rifle stock 501 while the top layer 110 (behind the bottom layer 120) of the device 100 contacts the human shooter in the cheek or jaw area just below the zygomatic arch and bone 510 and provides rest to the zygomatic arch and bone 510.

In an embodiment, when the zygomatic arch and bone 510 rests on the device 100, the device 100 fills a space between the maxilla 520 and the front of the mandible 530 with the rifle stock 501 and may apply an opposing force to push the rifle stock 501 (and the rifle by extension) away from the check and jaw area. The human head may be further tilted at least slightly vertically when device 100 is aligned with the zygomatic arch and bone 510. These forced movements creates a consistent, repeatable, and supported head position where the eyesight 541 (through eye socket 540) can be place straight down barrel at a consistent angle (if not necessary parallel) with the line of the device 542 and with less unnecessary head and body movements to get to the position. Therefore, the head of the shooter is held in a more natural position; the optic alignment happens faster, being more controlled. The head and optic alignment also remains more stable throughout the sighting, firing, and target reacquisition process.

In an embodiment, the maxilla 520 and mandible 530 are padded by the device 100 with comfortable and/or shock absorbent material (e.g., for providing further protection of the human shooter's face).

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this description, with each claim standing on its own as a separate preferred embodiment of the disclosure.

Moreover, though the description has included a description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A firearm adjustment device, comprising:

an attachment to an area of a stock of a firearm that is originally configured to receive a void comprising soft tissue at a cheek area between a zygomatic bone and a mandible of a shooter of the firearm; and a raised top extending from a side of the area, resulting in a thickness between the raised top and the attachment, wherein the thickness fills the void, wherein the raised top is longitudinally elongated, wherein the thickness supports the cheek area at a substantially same position as where the area is originally configured to receive the cheek area when the shooter is operating the firearm.

2. The device of claim 1, wherein the thickness is about 0.28 inches.

3. The device of claim 1, wherein a side of the raised top is angled with respect to the attachment and the raised top.

4. The device of claim 1, wherein the raised top is tactilely textured.

5. The device of claim 1, wherein the raised top comprises a monolithic piece of foam material.

6. The device of claim 1, wherein the attachment comprises adhesive.

7. The device of claim 1, wherein a width of the device is about 0.75 inches.

8. The device of claim 1, wherein a length of the device is about 5.5 inches.

9. A firearm stock adjustment device, comprising:

an attachment to an area of a stock of a firearm that is originally configured to receive a cheek area of a shooter of the firearm; and a raised top extending from a side of the area, resulting in a thickness between the raised top and the attachment, wherein the thickness fills a space between the cheek area and the area, wherein the raised top is longitudinally elongated, wherein the thickness supports the cheek area at a substantially same position as where the area is originally configured to receive the cheek area when the shooter is operating the firearm, wherein a width of the device is about 0.75 inches, and wherein a length of the device is about 5.5 inches.

10. The device of claim 9, wherein the thickness is about 0.28 inches.

11. The device of claim 9, wherein a side of the raised top is angled with respect to the attachment and the raised top.

12. The device claim 9, wherein the raised top is tactilely textured.

13. The device claim 9, wherein the raised top comprises a monolithic piece of foam material.

14. The device of claim 9, wherein the attachment comprises adhesive.

15. The device of claim 9, wherein the raised top provides rest to a zygomatic bone of the shooter.

16. The device of claim 9, wherein the space is between a maxilla and a mandible of the shooter and the firearm.

17. A firearm adjustment device, comprising:

an attachment to an area of a stock of a firearm that is originally configured to receive a cheek area of a shooter of the firearm; and a raised top extending from a side of the area, resulting in a thickness between the raised top and the attachment, wherein the thickness fills a space between the cheek area and the area, wherein the raised top comprises a monolithic piece of foam material, wherein the raised top is tactilely textured, wherein the raised top is longitudinally elongated, and wherein the thickness supports the cheek area at a substantially same position as where the area is originally configured to receive the cheek area when the shooter is operating the firearm.

18. The device of claim 17, wherein the thickness is about 0.28 inches.

19. The device of claim 17, wherein a width of the device is about 0.75 inches.

20. The device of claim 17, wherein the space is between a maxilla and a mandible of the shooter and the firearm.

* * * * *